US005966064A

United States Patent [19]

Yoshizawa et al.

[11] Patent Number: 5,966,064

[45] Date of Patent: Oct. 12, 1999

[54] NANOCRYSTALLINE ALLOY HAVING EXCELLENT PULSE ATTENUATION CHARACTERISTICS, METHOD OF PRODUCING THE SAME, CHOKE COIL, AND NOISE FILTER

[75] Inventors: Yoshihito Yoshizawa, Fukaya; Yoshio Bizen, Yasugi; Shunsuke Arakawa, Kumagaya, all of Japan

[73] Assignee: Hitachi Metals Ltd., Tokyo, Japan

[21] Appl. No.: 08/277,638

[22] Filed: Jul. 20, 1994

[30] Foreign Application Priority Data

Jul. 21, 1993 [JP] Japan ..... 5-179535

[51] Int. Cl.[6] ..... H01F 17/04; H01F 1/04

[52] U.S. Cl. ..... 336/221; 148/306; 148/307; 148/310; 148/311

[58] Field of Search ..... 148/306, 307, 148/310, 311; 336/221

[56] References Cited

U.S. PATENT DOCUMENTS

| | | | |
|---|---|---|---|
| 4,134,779 | 1/1979 | Ray et al. | 148/121 |
| 4,945,339 | 7/1990 | Yamauchi | 148/307 |
| 5,154,983 | 10/1992 | Watanabe | 428/611 |
| 5,156,922 | 10/1992 | Mishima et al. | 428/570 |
| 5,178,689 | 1/1993 | Okamura et al. | 148/306 |
| 5,225,006 | 7/1993 | Sawa et al. | 148/304 |
| 5,244,627 | 9/1993 | Katsuki | 420/127 |

FOREIGN PATENT DOCUMENTS

| | | |
|---|---|---|
| A0271657 | 6/1988 | European Pat. Off. . |
| A0374847 | 6/1990 | European Pat. Off. . |
| A3435519 | 4/1985 | Germany . |
| A4230986 | 3/1993 | Germany . |
| B 4-4393 | 3/1989 | Japan . |

OTHER PUBLICATIONS

M. Vazquez et al, Digests of Intermag, Apr. 13, 1993, p. AD11.

*Primary Examiner*—Michael L. Gellner
*Assistant Examiner*—Anh Mai
*Attorney, Agent, or Firm*—Sughrue, Mion, Zinn, Macpeak & Seas, PLLC

[57] ABSTRACT

A nanocrystalline alloy wherein at least 50 volume % of an alloy structure consists of a crystal grain mainly comprising bcc-phase having a grain size of 50 nm or less, a saturation magnetic flux density of the alloy is 1 T or more, a remanent flux density of the alloy is 0.4 T or less, and an Fe—B compound phase is partially formed in the alloy. The nanocrystalline alloy produced by heat treatment without applying any magnetic field shows pulse attenuation characteristics comparable to or more excellent than those of a nanocrystalline alloy obtained by heat treatment in a magnetic field.

19 Claims, 5 Drawing Sheets

NANOCRYSTALLINE ALLOY HAVING EXCELLENT PULSE ATTENUATION CHARACTERISTICS, METHOD OF PRODUCING THE SAME, CHOKE COIL, AND NOISE FILTER

BACKGROUND OF THE INVENTION

The present invention relates to a nanocrystalline alloy having excellent pulse attenuation characteristics and a method of producing it. The present invention further relates to a choke coil utilizing the nanocrystalline alloy and a noise filter composed of the choke coil.

As a material for a magnetic core of a common-mode choke coil used in a noise filter, a high permeability material having excellent high-frequency properties such as ferrite, amorphous alloy, etc. has been used. In addition, JP-B-4-4393 discloses that an Fe-based fine crystalline alloy (nanocrystalline alloy) is suitable as a material for such a magnetic core because it has a high permeability and low core loss.

The material for a common-mode choke coil used in a noise filter (line filter) is further required to have not only a high permeability but also excellent pulse attenuation characteristics for preventing disordered operating of an apparatus due to high-voltage pulse noise caused by thunder, etc.

However, since the ferrite material, which has been conventionally used, is low in saturation magnetic flux density, it easily reaches a magnetically-saturated state. This results in a problem that a small-sized core made of the ferrite material cannot meet the above requirements and such a core shows only insufficient efficiency. Therefore, a large-sized core is necessary for obtaining a high efficiency when ferrite is used as the core material.

An Fe-based amorphous alloy has a high saturation magnetic flux density and shows, with respect to a high-voltage pulse noise, more excellent attenuation characteristics than those shown by the ferrite material. However, since the permeability of the Fe-based amorphous alloy is lower than that of a Co-based amorphous alloy, it shows insufficient attenuation to a low-voltage noise. In addition, the Fe-based amorphous alloy has a remarkably large magnetostriction. This invites further problems such as alteration in its properties caused by a resonance which may occur at a certain frequency due to the magnetostriction, and occurrence of beat in case of including audio frequency component.

On the other hand, a Co-based amorphous alloy shows a large attenuation to low-voltage noise due to its high permeability. However, its saturation magnetic flux density is lower than 1 T or less and it shows poor attenuation to high-voltage pulse noise as compared with an Fe-based amorphous alloy. Further, the Co-based amorphous alloy of a high permeability largely changes, in particular under environment of a high surrounding temperature, its properties with the passage of time, this resulting in lack of reliance.

As described above, the Fe-based fine crystalline alloy (nanocrystalline alloy) disclosed in JP-B-4-4393 has been known to have a high permeability and low core loss. However, the conventional Fe-based fine crystalline alloy is usually subjected to heat treatment while applying a magnetic field in the transverse direction (width direction) of a thin alloy ribbon in order to improve its pulse attenuation characteristics, because it cannot be provided with sufficient attenuation characteristics when subjected to heat treatment without applying any magnetic field. However, in this heat treatment in a magnetic field, it is required to make a core material (a thin alloy ribbon) magnetically saturated by the applied magnetic field. For meeting this requirement, a magnetic field of 1000 A/m or more is necessary to be applied because of a large demagnetizing field. Therefore, the heat treatment in a magnetic field is costly due to a great deal of consumed electrical power. In addition, it is low in productivity due to the necessity to keep the core to be treated at an accurate location because the application direction of magnetic field must be maintained at a constant direction. As described above, when the Fe-based fine crystalline alloy is subjected to heat treatment without applying any magnetic field, it cannot be provided with a sufficient attenuation to a high-voltage pulse noise. Therefore, if a nanocrystalline alloy having pulse attenuation characteristics comparable to or more excellent than that of a nanocrystalline alloy produced by heat treatment in a magnetic field can be produced by without applying any magnetic field, its industrial advantage would be greatly significant.

OBJECT AND SUMMARY OF THE INVENTION

Accordingly, an object of the present invention is to provide a nanocrystalline alloy having pulse attenuation characteristics comparable to or more excellent than that of a nanocrystalline alloy produced by heat treatment in a magnetic field.

Another object of the present invention is to provide a method of producing a nanocrystalline alloy having pulse attenuation characteristics comparable to or more excellent than that of a nanocrystalline alloy produced by heat treatment in a magnetic field by heat treatment without applying any magnetic field.

Still another object of the present invention is to provide a choke coil utilizing the nanocrystalline alloy as defined above.

A further object of the present invention is to provide a noise filter composed of the choke coil as defined above.

As a result of the intense research in view of the above objects, the present inventors have found that a magnetic core made of a nanocrystalline alloy wherein at least 50 volume % of an alloy structure is occupied by crystal grains having a grain size of 50 nm or less, said crystal grains comprising a bcc-phase as a main component and an Fe—B compound phase; a saturation magnetic flux density of the alloy is 1 T or more; and a remanent flux density of the alloy is 0.4 T or less shows excellent pulse attenuation characteristics, although the magnetic core is subjected to heat treatment without applying any magnetic field. The present inventors further found that such a magnetic core is useful for a common-mode choke coil, etc. The present invention has been accomplished based on these findings.

In a first aspect of the present invention, there is provided a nanocrystalline alloy wherein at least 50 volume % of an alloy structure is occupied by crystal grains having a grain size of 50 nm or less, said crystal grain comprising a bcc-phase as a main component and an Fe—B compound phase; a saturation magnetic flux density of the alloy is 1 T or more; and a remanent flux density of the alloy is 0.4 T or less.

In a second aspect of the present invention, there is provided a choke coil composed of a magnetic core constituted by the nanocrystalline alloy as defined above and a coil of wire wound around the magnetic core.

In a third aspect of the present invention, there is provided a noise filter composed of the choke coil.

In a fourth aspect of the present invention, there is provided a method for producing the nanocrystalline alloy as defined above.

DETAILED DESCRIPTION OF THE INVENTION

Figure 1:
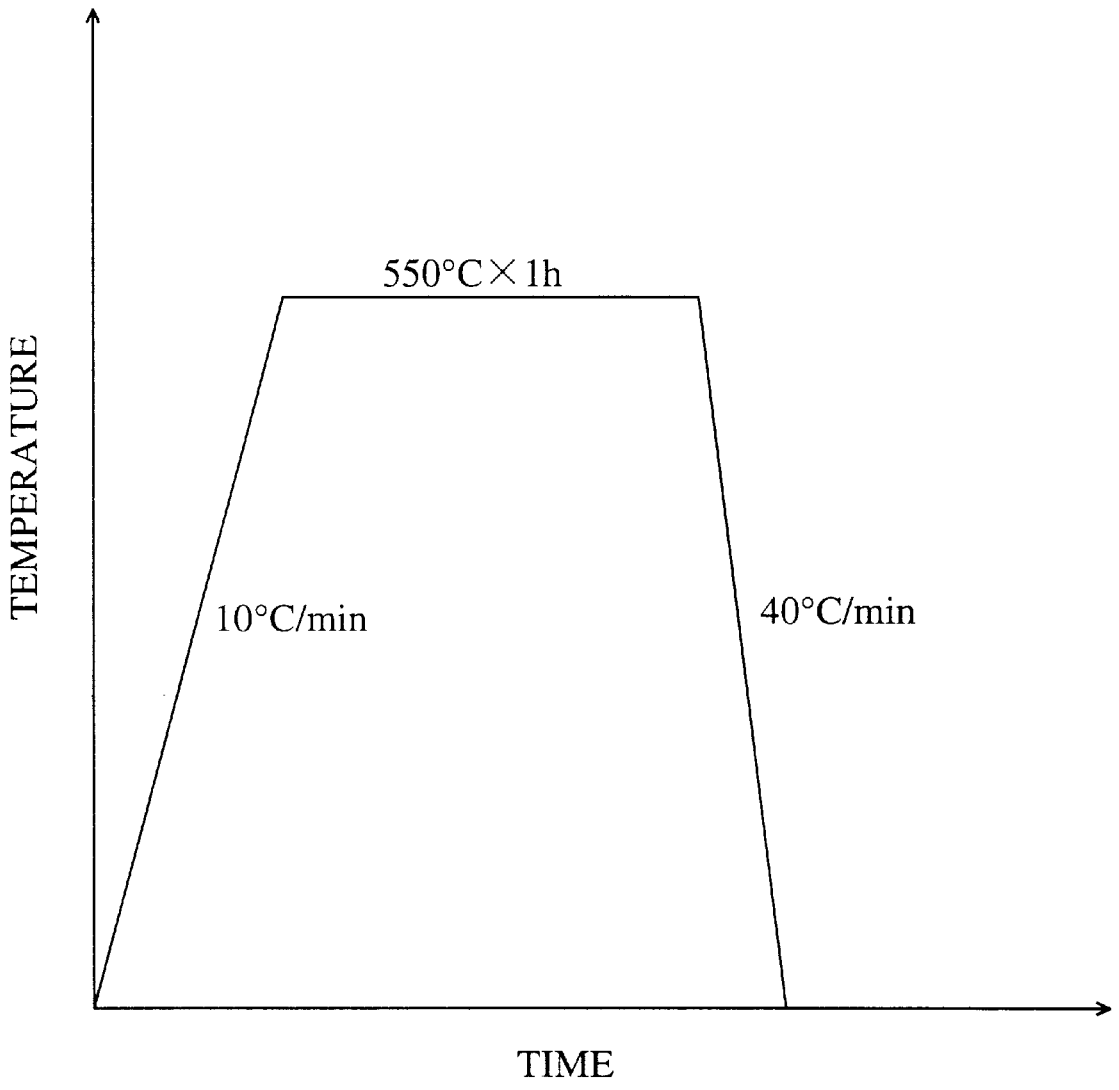
FIG. 1 is a graph showing a heat treatment pattern of an alloy in the production of the nanocrystalline alloy of the present invention.

In the nanocrystalline alloy of the present invention, the remanent flux density is 0.4 T or less. A remanent flux density exceeding 0.4 T is not preferred because the attenuation begins to reduce at a lower voltage, this resulting in increase of the output voltage.

The saturation magnetic flux density of the present nanocrystalline alloy is 1 T or more. When the saturation magnetic flux density is less than 1 T, the pulse attenuation characteristics are undesirably deteriorated.

The crystal grain in the nanocrystalline alloy mainly comprises bcc-phase (body centered cubic lattice phase) containing Fe as a main component, and may contain an ordered lattice phase. Generally, alloying elements such as Si, etc. are contained as a solid solution component in the bcc-phase. Further, the nanocrystalline alloy may partially contain amorphous phase in addition to crystalline phase, or it may substantially comprise only the crystalline phase. For obtaining excellent pulse attenuation characteristics, the grain size is desired to be 50 nm or less, preferably 30 nm or less and more preferably 20 nm or less. Further, the content of the crystal grain is 50 volume % or more of the alloy structure. If the content is less than 50 volume %, the magnetostriction becomes larger, resulting in an undesirable abrupt change in the permeability at a certain frequency due to resonance caused by magnetostriction in the high frequency region.

The formation of the Fe—B compound phase in the nanocrystalline alloy is important in the present invention. The Fe—B compound phase has an effect of reducing the remanent flux density and improving the pulse attenuation characteristics.

The Fe—B compound phase is formed usually in the vicinity of the surfaces of the nanocrystalline alloy. The nanocrystalline alloy of the present invention is usually formed into a thin ribbon having a thickness from 2 μm to 50 μm. The thickness is preferred to be 25 μm or less, more preferably 15 μm, in view of enhancing the effect to a pulse with a narrow pulse width. In the present invention, the vicinity of the surfaces of alloy means a region within one quarter of the thickness from the surfaces of a thin alloy ribbon. For example, when the thickness of a thin alloy ribbon is 20 μm, the vicinity of the surfaces is a region within 5 μm from the surfaces of the thin alloy ribbon. In addition, the Fe—B compound phase comprises, for example, $Fe_2B$, $Fe_3B$, $Fe_{23}B_6$, $(FeM)_2B$[Mo,Ti, Zr, Hf, V, Nb, Ta], $(FeM)_3B$, etc.

Preferred compositions of the nanocrystalline alloy of the present invention are represented by the following formulae:

$$(Fe_{1-a}M_a)_{100-x-y-z-\alpha}A_xSi_yB_zM'_\alpha \text{ (atomic \%)}, \quad (1)$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, and a, x, y, z and α respectively satisfy $0 \leqq a \leqq 0.3$, $0 \leqq x \leqq 3$, $0 \leqq y \leqq 20$, $2 \leqq z \leqq 15$, and $0.1 \leqq \alpha \leqq 10$;

$$(Fe_{1-a}M_a)_{100-x-y-z-\alpha-\beta}A_xSi_yB_zM'_\alpha M''_\beta \text{ (atomic \%)}, \quad (2)$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, M" is at least one element selected from the group consisting of Al, Sn, In, Ag, Pd, Rh, Ru, Os, Ir, and Pt, and a, x, y, z, α and β respectively satisfy $0 \leqq a \leqq 0.3$, $0 \leqq x \leqq 3$, $0 \leqq y \leqq 20$, $2 \leqq z \leqq 15$, $0.1 \leqq \alpha \leqq 10$, and $0 \leqq \beta \leqq 10$; and $$(Fe_{1-a}M_a)_{100-x-y-z-\alpha-\beta-\gamma}A_xSi_yB_zM'_\alpha M''_\beta X_\gamma \text{ (atomic \%)}, \quad (3)$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, M" is at least one element selected from the group consisting of Al, Sn, In, Ag, Pd, Rh, Ru, Os, Ir, and Pt, X is at least one element selected from the group consisting of C, Ge, Ga and P, and a, x, y, z, α, β and γ respectively satisfy $0 \leqq a \leqq 0.3$, $0 \leqq x \leqq 3$, $0 \leqq y \leqq 20$, $2 \leqq z \leqq 15$, $0.1 \leqq \alpha \leqq 10$, $0 \leqq \beta \leqq 10$, and $0 \leqq \gamma \leqq 10$.

The nanocrystalline alloy having the above composition is preferred because of its excellent direct current superposition and low core loss.

In the above formula, M is at least one element selected from Co and Ni. If the content of M ("a") exceeds 0.3, the pulse attenuation characteristics are unfavorably deteriorated. A preferred range for "a" is below 0.2. A is at least one element selected from Cu and Au. This component has an effect to refine the alloy structure thereby making the formation of the bcc-phase easy. However, embrittlement takes place if the content of A ("x") exceeds 3 atomic %, thereby making an alloy impractical. A preferred range for "x" is 0.5 to 2 atomic %. M' is at least one element selected from the group consisting of Ti, Zr, Hf, V, Nb, Ta, Cr, Mo, W and Mn, and has an effect of refining the alloy structure by controlling grain growth and an effect of improving the direct current superposition. If the content of M' ("α") exceeds 10 atomic %, the saturation magnetic flux density is remarkably lowered. Therefore, "α" is preferred to be 10 or less, and more preferably 2 to 7 atomic %. M" is at least one element selected from the group consisting of Al, Sn, In, Ag, Pd, Rh, Ru, Os, Ir, and Pt, and has effects of improvement in refining crystal grain or in corrosion resistance. If the content of M" ("β") exceeds 10 atomic %, the saturation magnetic flux density is remarkably lowered. Therefore, "β" is preferred to be 10 or less, and more preferably 5 or less. X is at least one element selected from the group consisting of C, Ge, Ga and P, and has an effect of controlling the magnetostriction and other magnetic properties. If the content of X ("γ") exceeds 10 atomic %, the saturation magnetic flux density is remarkably lowered. Therefore, "γ" is preferred to be 10 or less, and more preferably 5 or less. The components, Si (silicon) and B (boron), have an effect of improvement in the core loss and permeability. The content of Si ("y") is 20 or less, preferably 5 to 17 atomic %. The content of B ("z") is 2 to 15, preferably 5 to 10 atomic %.

Incidentally, with respect to inevitable impurities such as N, O, S, etc., it is to be noted that the inclusion thereof in such amounts as not to deteriorate the desired properties is not regarded as changing the alloy composition of the present invention suitable for magnetic cores, etc.

The nanocrystalline alloy described above can be produced by a method which will be explained below.

The method of producing the nanocrystalline alloy of the present invention comprises a step of forming a thin ribbon of an amorphous alloy by known melt quenching methods such as a single roll method, a double roll method, etc. and a step of heat-treating the resultant thin alloy ribbon at a temperature equal to or higher than the crystallization temperature (crystallization-initiating temperature) for 5 minutes to 100 hours thereby transforming the amorphous alloy into an alloy in which at least 50 volume % of an alloy structure is occupied by the crystal grains having a grain size of 50 nm or less, the crystal grain mainly comprising the bcc-phase and partially including the Fe—B compound phase, the remanent magnetic flux density of the alloy is 0.4 T or less and the saturation magnetic flux density is 1 T or more. The crystallization temperature referred to in the present invention is a temperature at which the heat generated by crystallization is observed when an amorphous alloy is heated at a rate of 10° C./min in a differential scanning calorimeter.

Specifically, a thin ribbon of amorphous alloy having a thickness of 2 to 50 $\mu$m is first formed by melt quenching method such as single roll method, double roll method, etc. In this case, the thin ribbon may partially includes crystalline phase such as bcc-phase, Fe—B compound phase, etc. Then, the thus obtained thin ribbon is, after laminating or winding into a toroidal form, etc., subjected to heat treatment at a crystallization temperature or a temperature higher than it for 5 minutes to 100 hours in an atmosphere of inert gas such as argon gas, nitrogen gas, etc. or in air. By this heat treatment, at least 50 volume % of the alloy structure comes to be occupied by the crystal grains having a grain size of 50 nm or less. The crystal grain mainly comprises the bcc-phase, and partially comprises the Fe—B compound phase which has an effect for reducing the remanent flux density. Thus, the pulse attenuation characteristics can be improved. This improving effect becomes more remarkable when the Fe—B compound phase is formed in the vicinity of the surfaces. The annealing temperature is desired to be in the range of a crystallization temperature or higher. When the heat treatment is carried out at a temperature lower than the crystallization temperature, it requires too much time for the heat treatment to complete the crystallization. Further, it also require too much time to form the Fe—B compound phase, this making it difficult to attain the improved properties described above. The annealing time is preferred to be 5 minutes to 100 hours. It is difficult to heat the overall worked alloy at a uniform temperature, resulting in failure in obtaining sufficient properties when the annealing time is shorter than 5 minutes. A annealing time over 100 hours is not preferred in view of productivity. A heat-treated alloy may be cooled by quenching or slow cooling. However, the cooling speed is preferred to be 0.1° C./min or higher in order to avoid a deterioration of the pulse attenuation characteristics. As described above, the nanocrystalline alloy having excellent properties can be obtained by a method including heat treatment without applying any magnetic field. However, the beneficial effect of the present invention can be attained also by a method including heat treatment with applying a magnetic field. Therefore, it should be noted that such a technique is also encompassed into the scope of the present invention.

In addition, the thin ribbon of the nanocrystalline alloy may be provided with inter-laminar insulation by coating the surfaces thereof with an oxide such as $SiO_2$, $Al_2O_3$, etc. for obtaining more preferred effect. As a method for providing layer insulation, are exemplified a method of adhering on the surface an oxide such as MgO by electrophoresis, a method of applying on the surface a metal alkoxide solution and heat-treating it to form an oxide such as $SiO_2$, a method of treating with a phosphate or chromate to form a coating of an oxide on the surface, a method of forming on the surface a coating of AlN, TiN, etc. by CVD PVD, etc.

Further, in the method of the present invention, a two-stage heat treatment consisting of a first heat treatment step for forming the bcc-phase and a second heat treatment step for forming the Fe—B compound phase may be employed in place of the single-stage heat treatment described above. In the first heat treatment step, the thin ribbon of amorphous alloy is heat-treated at a temperature 450 to 600° C. for 5 minutes to 24 hours (in a temperature range and period of time not to form Fe—B compound phase) in air or an inert atmosphere such as argon gas and nitrogen gas atmosphere. In the second heat treatment step, the alloy subjected to the first heat treatment is further heat-treated at a temperature 550 to 700° C. for 5 minutes to 24 hours in air or an inert atmosphere such as argon gas and nitrogen gas atmosphere. In this two-stage heat treatment, the formation of Fe—B compound phase can be easily controlled, and variation in the properties and difference in characteristics depending on the shape of the final alloy ribbon can be minimized.

A choke coil of the present invention is composed of a magnetic core constituted by the nanocrystalline alloy and a coil of wire wound around the core. A common-mode choke coil of the present invention is composed of a magnetic core constituted by the nanocrystalline alloy and at least two coils of wire wound around the core.

These choke coil and common-mode choke coil are produced by, for example, the following method. A thin ribbon of amorphous alloy produced by single roll method mentioned above is wound to form a toroidal core, or several sheets of such thin ribbons are laminated to form a laminated ring core, etc. Then, the thus obtained cores are subjected to heat treatment at a temperature equal to or higher than a crystallization temperature so that at least 50 volume % of the alloy structure is occupied by the crystal grains having a grain size of 50 nm or less. Finally, after putting the thus treated core into an insulating core case or providing the core surface with a coating, the core is wound with a coil of wire or at least two coils of wire to obtain a choke coil or a common-mode choke coil.

A noise filter utilizing the choke coil or common-mode choke coil can be easily obtained in accordance with a conventionally employed production method.

The present invention will be further described while referring to the following non-limitative Examples.

EXAMPLE 1

A thin alloy ribbon having a width of 6.5 mm and a thickness of 16 $\mu$m was produced by quenching a molten alloy of $Fe_{bal.}Co_{15}Cu_1Nb_2Si_{11}B_9$ by using single roll method. The thin alloy ribbon was confirmed to be amorphous because the X-ray diffraction of it showed only halo patterns. Then, a toroidal core of 20 mm outer diameter and 10 mm inner diameter obtained by winding the thin alloy ribbon was subjected to heat treatment in nitrogen atmosphere without applying any magnetic field. The heat treatment conditions are shown in FIG. 1.

Figure 2A:
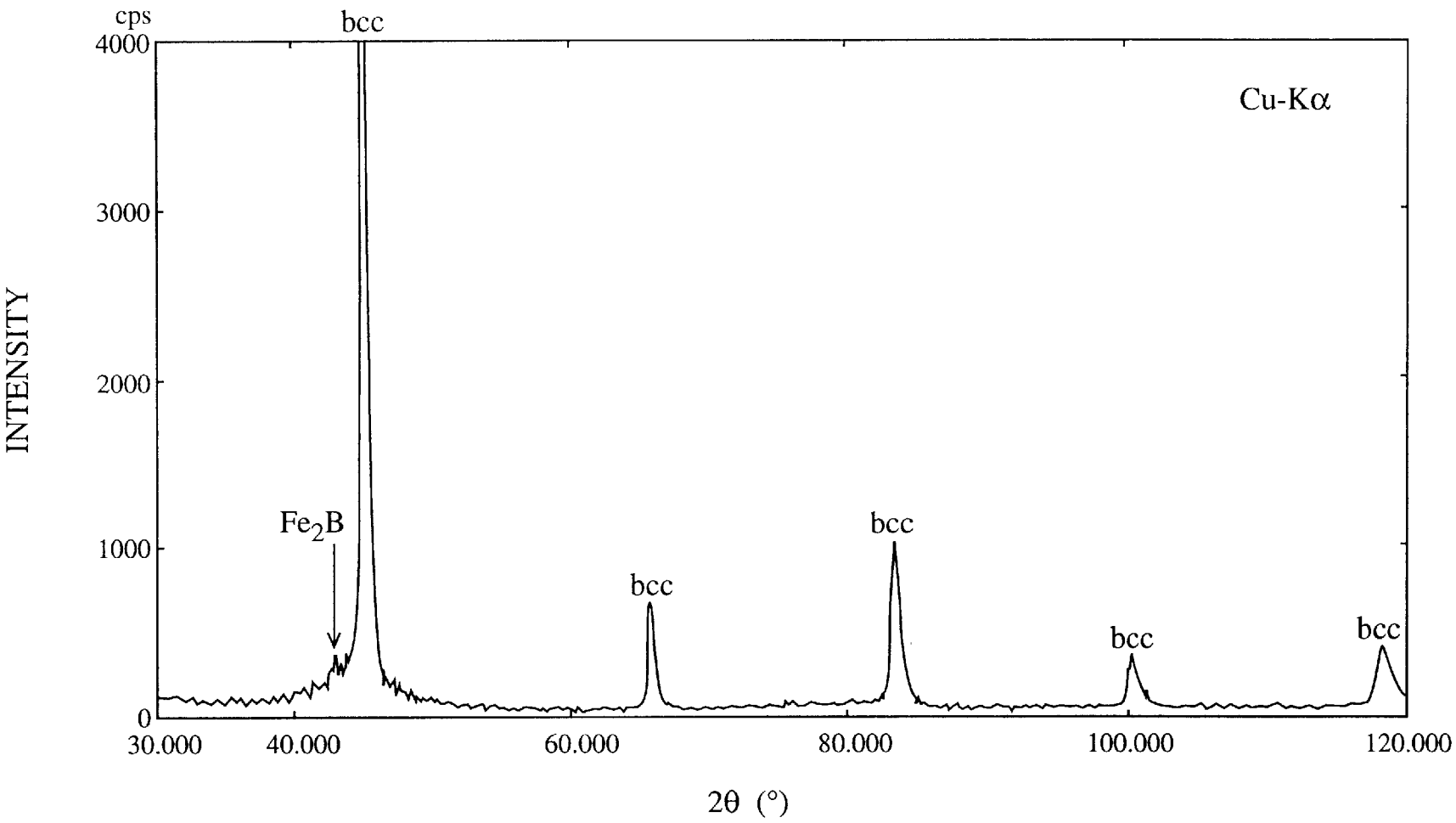
FIG. 2*a* is an X-ray diffraction pattern of the nanocrystalline alloy of the present invention.
Figure 2B:
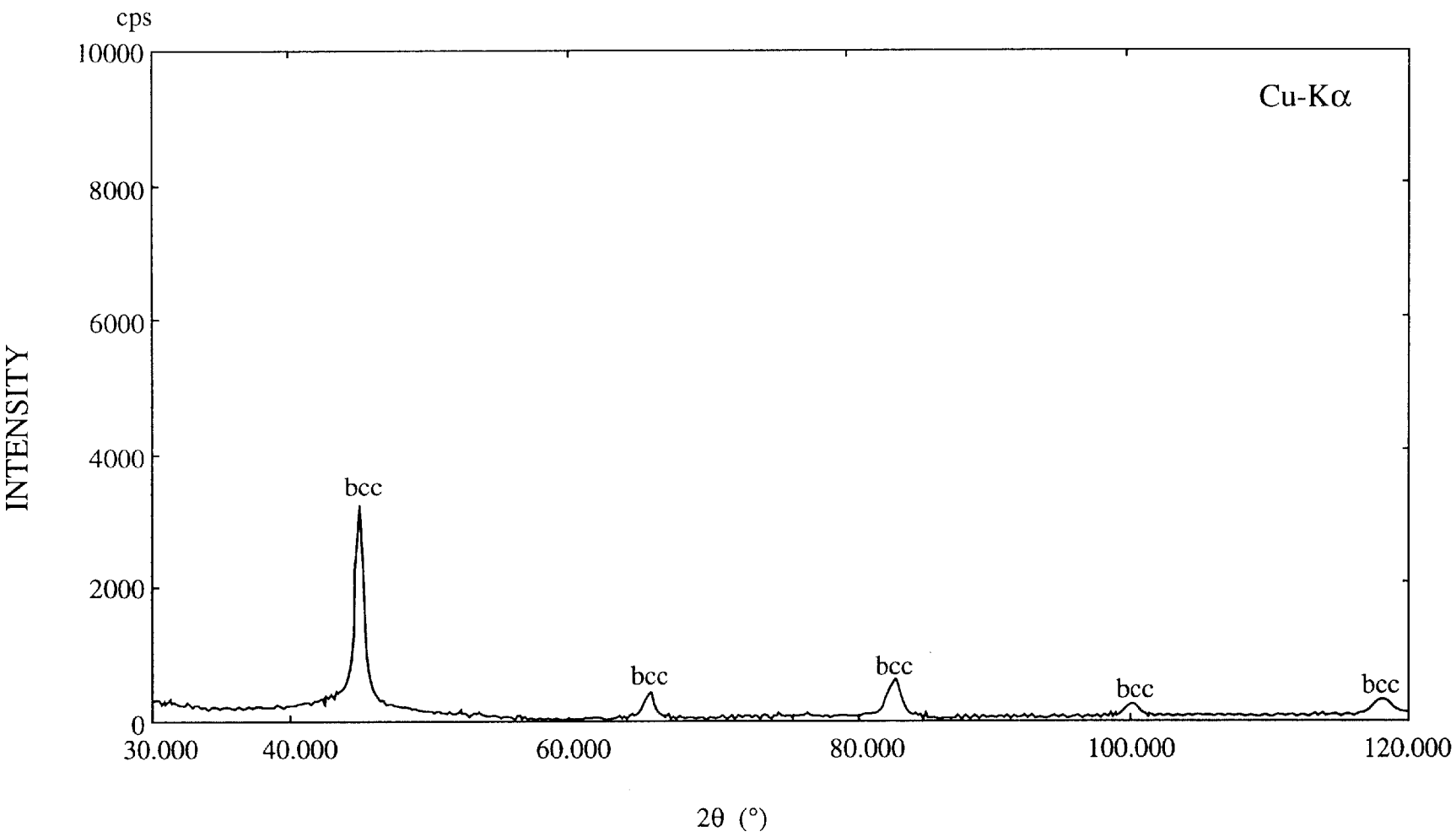
FIG. 2*b* is an X-ray diffraction pattern of a conventional alloy.

The X-ray diffraction pattern of the thus heat-treated alloy is shown in FIG. 2*a*. Further, as a comparison, the X-ray diffraction pattern of a conventional nanocrystalline alloy ($Fe_{bal.}Cu_1Nb_3Si_{13.5}B_9$) subjected to the same heat treatment as above is shown in FIG. 2*b*. As seen from FIG. 2*a*, the X-ray diffraction pattern of the alloy of the present invention shows a peak based on Fe—B compound phase in addition to the peaks based on bcc-Fe(Si) phase. On the other hand, the conventional alloy shows only peaks based on bcc phase.

Further, from the observation with a transmission electron microscope on the heat-treated alloy of the present invention, it was confirmed that nearly all parts of the structure were occupied with crystal grain having a grain size of 50 nm or less.

Then, the thin alloy ribbon of the present invention was subjected to X-ray diffraction after removing the surface layer by etching. When the surface layer was removed up to a depth more than 4 μm, the X-ray diffraction pattern showed no peak based on Fe—B compound phase. Thus, in the alloy of the present invention, Fe—B compound phase was confirmed to be formed in the region within 4 μm depth from the surface.

Figure 3:
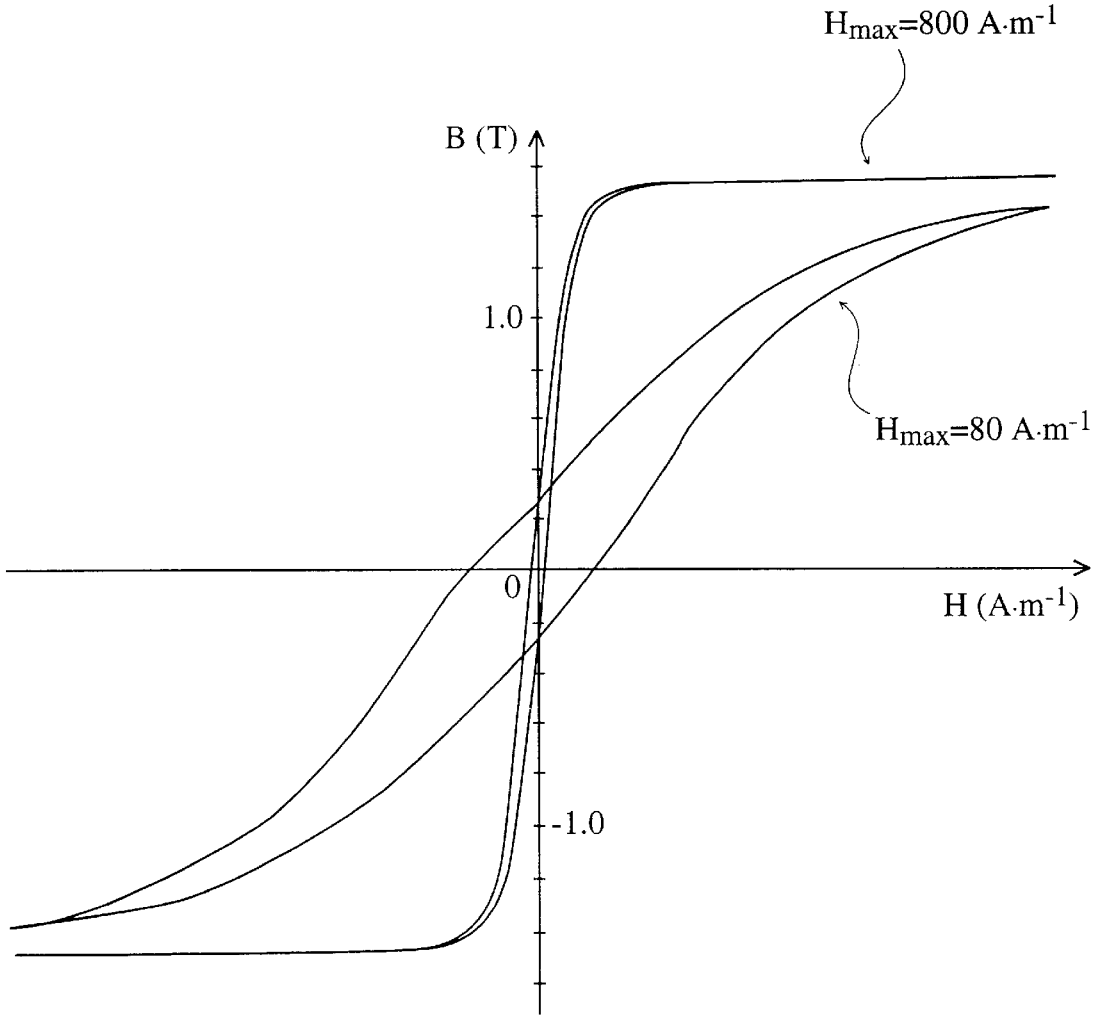
FIG. 3 is a graph showing direct current B—H loops of the nanocrystalline alloy of the present invention.

The heat-treated core was put into a core case made of phenol resin, and the magnetic characteristics of the core was measured to obtain the direct current B—H loops shown in FIG. 3. As seen from FIG. 3, the saturation magnetic flux density ($B_s$) was 1.52 T and the remanent flux density ($B_r$) was 0.26 T.

The core was wound with 12 turns of wire to obtain a choke coil and the pulse attenuation characteristics of it on a pulse with 800 ns width were measured. The result obtained and the measuring circuit used are respectively shown in FIGS. 4*a* (line 1) and 4*b*. In FIG. 4*b*, the reference numeral 5 is a sample core to be measured and the reference numerals 6 and 7 respectively show a noise simulator and an oscilloscope. By using the conventional nanocrystalline alloy mentioned above, and Fe—Si—B amorphous alloy, respective choke coils were produced according to the same manner as above. The pulse attenuation characteristics of them, measured by the same manner as above, are also shown in FIG. 4*a* (line 2 for the conventional nanocrystalline alloy, line 3 for Mn—Zn ferrite and line 4 for Fe—Si—B amorphous alloy).

Figure 4A:
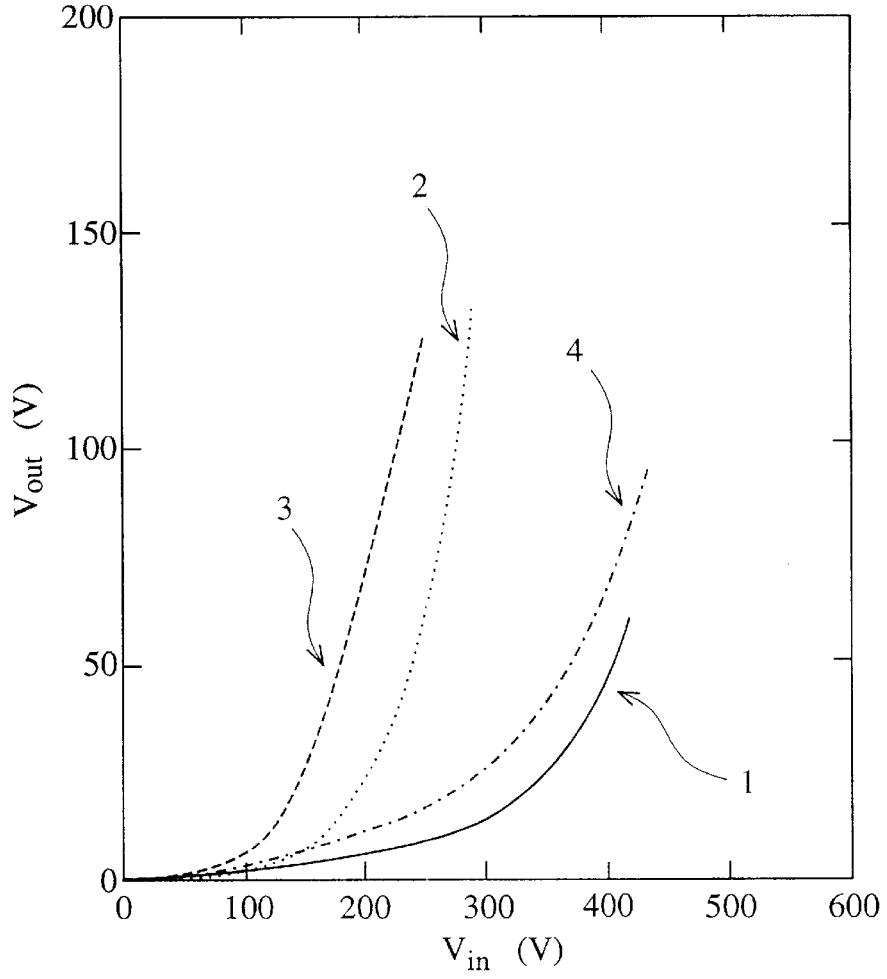
FIG. 4*a* is a graph showing the pulse attenuation characteristics of the magnetic cores composed of the nanocrystalline alloy of the present invention or the conventional materials.
Figure 4B:
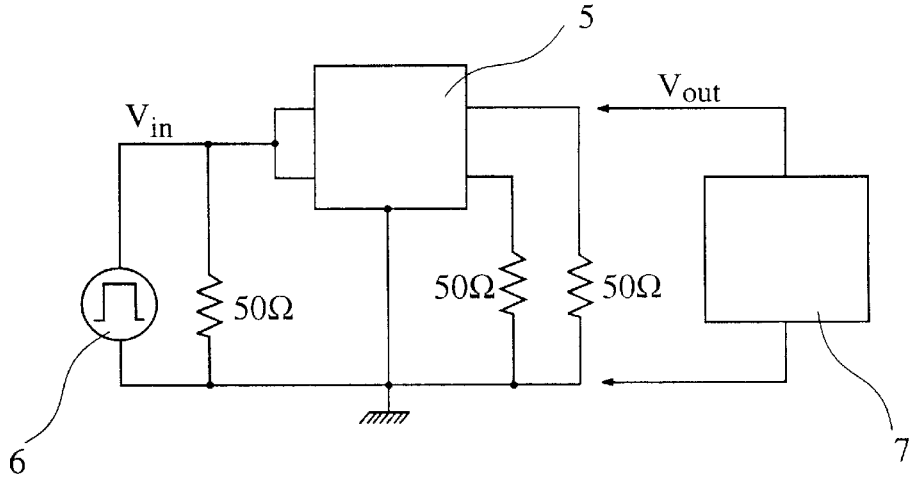
FIG. 4*b* is a schematic view showing a measuring circuit used for measuring pulse attenuation characteristics.

As seen from FIG. 4*a*, the choke coil having a core made of the nanocrystalline alloy of the present invention shows a low output voltage even at a high input voltage at which other choke coils each having a core made of the known material shows an output voltage higher than that of the present invention. Thus, the choke coil of the present invention has excellent pulse attenuation characteristics because it shows an attenuation larger than that of the conventional choke coil even at a high input voltage.

EXAMPLE 2

Each thin alloy ribbon having a width of 6.5 mm and a thickness of 12 μm was produced by quenching a molten alloy of each alloy listed in Table 1 by using single roll method. Then, a toroidal core of 20 mm outer diameter and 10 mm inner diameter obtained by winding each of the thin alloy ribbons was subjected to heat treatment at 590° C. for 2 hours in argon atmosphere without applying any magnetic field. From the X-ray diffraction patterns and observation with a transmission electron microscope on the heat-treated alloy, it was confirmed that at least 50 volume % of the alloy structure was occupied with crystal grain mainly comprising bcc-phase and having a grain size of 50 nm or less. A choke coil having a core made of each alloy was produced, and the pulse attenuation characteristics of the choke coil was measured according to the manner in Example 1. The results are shown in the following Table 1, in which the term $V_{out}$ means the output pulse voltage at an input pulse voltage ($V_{in}$) of 200 V.

TABLE 1

| Composition (atomic %) | $V_{out}$ (V) | Fe—B Compound Phase |
|---|---|---|
| Present Invention | | |
| $Fe_{bal.}Cu_1Mo_3Si_{16}B_6$ | 11.8 | Exist |
| $Fe_{bal.}Co_{14}Cu_1Nb_2Si_{11}B_9$ | 8.3 | Exist |
| $Fe_{bal.}Co_{14}Au_1Nb_2Si_{11}B_9$ | 8.6 | Exist |
| $Fe_{bal.}Co_{10}Cu_1Nb_2Si_{11}B_9P_1$ | 8.5 | Exist |
| $Fe_{bal.}Cu_1W_3Si_{16}B_6$ | 11.9 | Exist |
| $Fe_{bal.}Co_{14}Cu_1Ta_2Si_{11}B_9$ | 8.9 | Exist |
| $Fe_{bal.}Co_7Cu_1Zr_7B_{6.5}$ | 11.8 | Exist |
| $Fe_{bal.}Cu_1Hf_6B_7$ | 12.3 | Exist |
| $Fe_{bal.}Ni_1Cu_1Nb_2Si_{10}B_9Al_{0.2}$ | 12.5 | Exist |
| Comparative Examples | | |
| $Fe_{bal.}Cu_1Mo_3Si_{16}B_6$ (nanocrystalline alloy) | 23.2 | None |
| Mn—Zn ferrite | 75.0 | — |
| Fe—Si—B amorphous alloy | 29.2 | — |

From Table 1, it can be seen that the choke coil of the present invention shows a low output voltage ($V_{out}$) and is excellent in pulse attenuation characteristics.

EXAMPLE 3

Each thin alloy ribbon having a width of 6.5 mm and a thickness of 10 μm was produced by quenching a molten alloy of each alloy listed in Table 2 by means of single roll method. Then, 10 pieces of toroidal cores of 20 mm outer diameter and 10 mm inner diameter obtained by winding the thin alloy ribbon were subjected together to first heat treatment at 500° C. for 1 hour in nitrogen gas atmosphere without applying any magnetic field. The thus heat-treated alloy was confirmed by X-ray diffraction that there was no crystal phase other than bcc-phase in the alloy structure. Then, the alloy was further subjected to second heat treatment at a temperature higher than that in the first heat treatment. The result of X-ray diffraction of the thus treated alloy indicated that the peaks based on Fe—B compound phase such as $Fe_2B$ were appear in addition to the peaks base on bcc-phase. Further, from the observation with a transmission electron microscope, it was confirmed that at least 50 volume % of the alloy structure comprised crystal grain having a grain size of 50 nm or less.

The pulse attenuation characteristics of the choke coils produced from each toroidal core were measured according to the same manner as in Example 1. The results ($V_{out}$) obtained by the measurement conducted on 10 pieces of choke coils for each alloy composition are shown in Table 2. Further, for comparison, 10 pieces of choke coils for each alloy composition were produced by the same manner as above except for employing one-stage heat treatment (at 595° C. for 2 hours in nitrogen gas atmosphere). The results ($V_{out}$) obtained by the same measurement as above are also shown in Table 2.

TABLE 2

| Composition (atomic %) | $V_{out}$ (V) Heat Treatment 2-Stage | 1-Stage | Fe—B Compound Phase |
|---|---|---|---|
| $Fe_{bal.}Cu_1Mo_4Si_{16}B_6Ga_{0.1}$ | 11.5–12.1 | 11.5–15.8 | Exist |
| $Fe_{bal.}Co_{14}Cu_1Nb_2Si_{11}B_9Mn_1$ | 8.1–8.5 | 8.1–10.3 | Exist |
| $Fe_{bal.}Co_{14}Cu_1Nb_2Si_{11}B_9V_1$ | 8.5–8.9 | 8.6–10.8 | Exist |
| $Fe_{bal.}Co_{12}Cu_1Nb_2Si_9B_9Sn_{0.1}$ | 8.7–9.1 | 8.8–11.2 | Exist |
| $Fe_{bal.}Co_{11}Cu_1Mo_4Si_{11}B_9C_{0.2}$ | 9.0–9.5 | 9.1–11.6 | Exist |
| $Fe_{bal.}Co_{14}Cu_1Nb_2Si_{11}B_9Ru_1$ | 7.9–8.4 | 8.2–12.2 | Exist |
| $Fe_{bal.}Co_{14}Cu_1Nb_2Ti_1Si_{11}B_9$ | 8.8–9.3 | 8.9–12.4 | Exist |
| $Fe_{bal.}Co_{14}Cu_1Nb_2Si_{11}B_9In_1$ | 8.9–9.3 | 9.0–13.1 | Exist |
| $Fe_{bal.}Co_{14}Cu_1Nb_2Si_{11}B_9Pd_1$ | 9.1–9.6 | 9.3–12.9 | Exist |
| $Fe_{bal.}Co_{14}Cu_1Nb_2Si_{11}B_9Pt_1$ | 8.8–9.4 | 8.9–11.8 | Exist |

From Table 2, it can be seen that the variation in $V_{out}$ can be preferably reduced by employing two-stage heat treatment consisting of a first heat treatment for crystallizing an amorphous phase to form bcc-phase and a second heat treatment for forming Fe—B compound phase. This effect is presumed to be caused by uneven distribution of temperature in the core because the crystallization is exothermic and the generated heat is likely to be kept inside the heat treatment system when a number of cores is treated at a time. By conducting the first heat treatment at a comparatively lower temperature and followed by the second heat treatment at a temperature higher than that of the first heat treatment, the temperature distribution of the core during the second heat treatment becomes more even as compared with the one-stage heat treatment. This even distribution of temperature is presumed to result in decreasing in property variation because the difference between the amount of Fe—B compound phase formed in the respective cores is reduced.

What is claimed is:

1. A nanocrystalline alloy having excellent pulse attenuation characteristics wherein at least 50 volume % of the alloy structure is occupied by crystal grains having a grain size of 50 nm or less, said crystal grains comprising a bcc-phase as a main component and an Fe—B compound phase; the saturation magnetic flux density of the alloy is 1 T or more; and the remanent flux density of the alloy is 0.4 T or less.

2. The nanocrystalline alloy having excellent pulse attenuation characteristics according to claim 1, wherein a part of or all of said Fe—B compound phase consists of $Fe_2B$ phase.

3. The nanocrystalline alloy having excellent pulse attenuation characteristics according to claim 1, wherein said Fe—B compound phase exists mainly or only in the vicinity of the surfaces of said nanocrystalline alloy.

4. The nanocrystalline alloy having excellent pulse attenuation characteristics according to claim 2, wherein said Fe—B compound phase exists mainly or only in the vicinity of the surfaces of said nanocrystalline alloy.

5. The nanocrystalline alloy having excellent pulse attenuation characteristics according to claim 1, wherein a composition of said nanocrystalline alloy is represented by the following formula:

$$(Fe_{1-a}M_a)_{100-x-y-z-\alpha}A_xSi_yB_zM'_\alpha \text{ (atomic \%)},$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, and a, x, y, z and α respectively satisfy $0 \leqq a \leqq 0.3$, $0 \leqq x \leqq 3$, $0 \leqq y \leqq 20$, $2 \leqq z \leqq 15$, and $0.1 \leqq \alpha \leqq 10$.

6. The nanocrystalline alloy having excellent pulse attenuation characteristics according to claim 1, wherein a composition of said nanocrystalline alloy is represented by the following formula:

$$(Fe_{1-a}M_a)_{100-x-y-z-\alpha-\beta}A_xSi_yB_zM'_\alpha M''_\beta \text{ (atomic \%)},$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, M" is at least one element selected from the group consisting of Al, Sn, In, Ag, Pd, Rh, Ru, Os, Ir, and Pt, and a, x, y, z, α and β respectively satisfy $0 \leqq a \leqq 0.3$, $0 \leqq x \leqq 3$, $0 \leqq y \leqq 20$, $2 \leqq z \leqq 15$, $0.1 \leqq \alpha \leqq 10$, and $0 \leqq \beta \leqq 10$.

7. A magnetic core made of the nanocrystalline alloy according to claim 1.

8. A choke coil comprising the magnetic core according to claim 7 and a wire wound around said magnetic core.

9. A noise filter comprising the choke coil according to claim 8.

10. A common-mode choke coil comprising the magnetic core according to claim 7 and at least two coils of wire wound around said magnetic core.

11. A noise filter comprising the common-mode choke coil according to claim 10.

12. A nonocrystalline alloy having excellent pulse attenuation characterisitics, which has a chemical composition represented by the following formula:

$$(Fe_{1-a}M_a)_{100-x-y-z-\alpha-\beta-\gamma}A_xSi_yB_zM'_\alpha M''_\beta X_\gamma \text{ (atomic \%)},$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, M" is at least one element selected from the group consisting of Al, Sn, In, Ag, Pd, Rh, Ru, Os, Ir, and Pt, X is at least one element selected from the group consistng of C, Ge, Ga and P, and a, x, y, z, α, β and γ respectively satisfy $0 \leqq a \leqq 0.3$, $0 \leqq x \leqq 3$, $0 \leqq y \leqq 20$, $2 \leqq z \leqq 15$, $0.1 \leqq \alpha \leqq 10$, $0 \leqq \beta \leqq 10$, and $0 \leqq \gamma \leqq 10$, wherein at least 50 volume % of the alloy structure is occupied by crystal grains having a grain size of 50 nm or less, said crystal grains comprising a bcc-phase as a main component and an Fe—B compound phase; the saturation magnetic flux density of the alloy is 1 T or more; and the remanent flux density of the alloy is 0.4 T or less.

13. The nanocrystalline alloy having excellent pulse attenuation characteristics according to claim 12, wherein a part of or all of said Fe—B compound phase consists of $Fe_2B$ phase.

14. The nanocrystalline alloy having excellent pulse attenuation characteristics according to claim 13, wherein said Fe—B compound phase exists mainly or only in the vicinity of the surfaces of said nanocrystalline alloy.

15. The nanocrystalline alloy having excellent pulse attenuation characteristics according to claim 12, wherein said Fe—B compound phase exists mainly or only in the vicinity of the surfaces of said nanocrystalline alloy.

16. A nanocrystalline alloy having excellent pulse attenuation characteristics, which has a chemical composition represented by the following formula:

$$(Fe_{1-a}M_a)_{100-x-y-z-\alpha-\beta-\gamma}A_xSi_yB_zM'_\alpha M''_\beta X_\gamma \text{ (atomic \%)},$$

wherein M is at least one element selected from Co and Ni, A is at least one element selected from Cu and Au, M' is at least one element selected from the group consisting of Ti, Zr, Hf, V, Nb, Ta, Cr, Mo, W and Mn, M" is at least one element selected from the group consisting of Al, Sn, In, Ag, Pd, Rh, Ru, Os, Ir, and Pt, X is at least one element selected from the group consisting of C, Ge, Ga and P, and a, x, y, z, $\alpha$, $\beta$ and $\gamma$ respectively satisfy $0 \leqq a \leqq 0.3$, $0 \leqq x \leqq 3$, $0 \leqq y \leqq 20$, $2 \leqq z \leqq 15$, $0.1 \leqq \alpha \leqq 10$, $0 \leqq \beta \leqq 10$, and $0 \leqq \gamma \leqq 10$, wherein at least 50 volume % of the alloy structure is occupied by crystal grains having a grain size of 50 nm or less, said crystal grains comprising a bcc-phase as a main component and an Fe—B compound phase; wherein the saturation magnetic flux density of the alloy is 1 T or more; and wherein the remanent flux density of the alloy is 0.4 T or less, said nanocrystalline alloy being produced by a two-stage heat treatment comprising the steps of:

forming a thin ribbon of amorphous alloy by a melt quenching method;

heat-treating said thin ribbon of amorphous alloy at 450 to 600° C. for 5 minutes to 24 hours in air or an inert atmosphere to form said bcc-phase; and further heat-treating said thin ribbon of amorphous alloy at a temperature higher than the first heat-treatment temperature and within the range of 550 to 700° C. for 5 minutes to 24 hours in air or an inert atmosphere to form said Fe—B compound phase.

17. The nanocrystalline alloy having excellent pulse attenuation characteristics according to claim 16, wherein a part of or all of said Fe—B compound phase consists of $Fe_2B$ phase.

18. The nanocrystalline alloy having excellent pulse attenuation characteristics according to claim 17, wherein said Fe—B compound phase exists mainly or only in the vicinity of the surfaces of said nanocrystalline alloy.

19. The nanocrystalline alloy having excellent pulse attenuation characteristics according to claim 16, wherein said Fe—B compound phase exists mainly or only in the vicinity of the surfaces of said nanocrystalline alloy.

* * * * *